US005204713A

United States Patent [19]

Yamamura

[11] Patent Number: 5,204,713

[45] Date of Patent: Apr. 20, 1993

[54] ELECTROPHOTOGRAPHIC APPARATUS

[75] Inventor: Naoki Yamamura, Shizuoka, Japan

[73] Assignee: Tokyo Electric Co., Ltd., Tokyo, Japan

[21] Appl. No.: 908,794

[22] Filed: Jul. 6, 1992

Related U.S. Application Data

[63] Continuation of Ser. No. 745,881, Aug. 16, 1991, abandoned.

[30] Foreign Application Priority Data

Aug. 24, 1990 [JP] Japan ..... 2-89083[U]

[51] Int. Cl.[5] ..... G03G 15/00

[52] U.S. Cl. ..... 355/210

[58] Field of Search ..... 355/200, 210, 211

[56] References Cited

U.S. PATENT DOCUMENTS

| | | | |
|---|---|---|---|
| 4,598,993 | 7/1986 | Mizutani et al. | 355/211 |
| 4,757,344 | 7/1988 | Idenawa et al. | 355/260 |
| 4,761,667 | 8/1988 | Miyai et al. | 355/315 |
| 4,866,482 | 9/1989 | Hirasawa et al. | 355/245 X |
| 4,873,940 | 10/1989 | Ishikawa et al. | 355/245 X |
| 4,876,572 | 10/1989 | Nagatsuna | 355/210 |
| 4,891,678 | 1/1990 | Ishizu et al. | 355/285 |
| 4,931,837 | 6/1990 | Abuyama et al. | 355/245 |
| 4,978,995 | 12/1990 | Takahashi | 355/211 X |
| 4,985,731 | 1/1991 | Sakakura et al. | 355/200 X |
| 4,987,446 | 1/1991 | Mochimaru et al. | 355/200 |
| 5,017,962 | 5/1991 | Tsuji et al. | 355/210 |
| 5,021,825 | 6/1991 | Niki | 355/210 X |
| 5,027,152 | 6/1991 | Oda et al. | 355/200 |
| 5,028,966 | 7/1991 | Kozuka et al. | 355/210 X |
| 5,036,358 | 7/1991 | Yoshida | 355/245 X |
| 5,049,940 | 9/1991 | Yamaguchi et al. | 355/260 |
| 5,055,053 | 4/1991 | Kozuka | 355/200 X |

FOREIGN PATENT DOCUMENTS

| | | |
|---|---|---|
| 62-159157 | 7/1987 | Japan . |
| 62-170979 | 7/1987 | Japan . |
| 1-111248 | 7/1989 | Japan . |
| 1-217481 | 8/1989 | Japan . |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

The present invention provides an electrophotographic apparatus comprising a housing containing a sheet transportation path, a transfer unit and a fixing unit, and having an open upper surface, a top cover holding an exposure unit and pivotally joined to the housing so as to cover the open upper surface of the housing, an image forming unit comprising a photoconductive drum and a charger, and a developing unit having a toner container. The image forming unit is supported on supporting members provided in the developing unit, and both the image forming unit and the developing unit are held by holding members provided in the housing. The developing unit is provided with upwardly projecting handles.

7 Claims, 6 Drawing Sheets

ELECTROPHOTOGRAPHIC APPARATUS

This application is a division of application Ser. No. 07/745,881, filed on Aug. 16, 1991, now abandoned.

FIELD OF THE INVENTION AND RELATED ART STATEMENT

The present invention relates to an electrophotographic apparatus and, more particularly, to an electrophotographic apparatus provided with a detachable image forming unit and a detachable developing unit.

Generally, the image forming unit of an electrophotographic apparatus is replaced frequently with a new one because its life is shorter than those of other components, and the developing unit of the same is removed frequently to replenish the same with a toner. As shown in FIG. 7, a conventional electrophotographic apparatus is provided with an image forming unit 56 comprising a waste toner container 54, a photoconductive drum 55 and a charger, a developing unit 59 comprising a toner container 57 provided with a developing roller, a blade and a stirrer, and a toner cartridge 58 combined with the toner container 57 a basket 50 having a partly open bottom wall, handles 51 and slots 52 and 53, containing the image forming unit 56 and the developing unit 59, and placed in a housing having an open upper surface. The image forming unit 56 is received in the basket 50 with bearings 60 rotatably supporting the photoconductive drum 55 received in the slots 52 of the basket 50, and the developing unit 59 is received in the basket 50 with projections 61 projecting outward in opposite directions, respectively, from the toner container 57 received in the slots 53. A sheet transportation path along which a sheet is transported, a transfer unit for transferring a toner image formed on the photoconductive drum 55 to a sheet and a fixing unit for fixing the toner image transferred from the photoconductive drum 55 to the sheet to the same, not shown, are arranged in the housing. An exposure unit, not shown, for applying light signals representing picture information to the photoconductive drum 55 is provided on a top cover, not shown, covering the open upper surface of the housing.

In removing the image forming unit 56 and the developing unit 59 from the housing, the top cover is opened and the basket 50 is held at the handles 51 and lifted up. In placing the image forming unit 56 and the developing unit 59 in the housing, the basket 50 containing the image forming unit 56 and the developing unit 59 is placed in the housing.

The electrophotographic apparatus shown in FIG. 7, however, needs the basket 50 as an additional part only for removing the image forming unit 56 and the developing unit 59 from and placing the same in the housing. Since the basket 50 is comparatively large, the housing must be formed in a comparatively large size and hence the cost of the electrophotographic apparatus increases accordingly.

OBJECT AND SUMMARY OF THE INVENTION

It is a first object of the present invention to provide an electrophotographic apparatus provided with an image forming unit and a developing unit which can detachably be installed in a housing without using any additional part, such as a basket.

A second object of the present invention is to facilitate removing an image forming unit and a developing unit from and placing the same in a housing.

A third object of the present invention to provide a processing unit comprising, in combination, an image forming unit and a developing unit.

A fourth object of the present invention is to facilitate separating an image forming unit from a developing unit.

The present invention provides an electrophotographic apparatus comprising: a housing containing a sheet transportation path, a transfer unit and a fixing unit, and having an open upper surface; a top cover holding an exposure unit and pivotally supported on the housing so as to cover the open upper surface of the same; an image forming unit comprising at least a photoconductive drum and a charger; a developing unit provided with a toner container; holding members disposed in the housing on the opposite sides, respectively, of the sheet transportation path to hold the image forming unit and the developing unit so as to be removed upward therefrom; supporting members provided in the developing unit to support the image forming unit; and handles attached to the developing unit so as to extend upward from the developing unit.

The image forming unit is supported on the supporting members of the developing unit. Therefore, the image forming unit can be removed together with the developing unit from the housing by holding the developing unit at the handles and lifting up the developing unit after turning the top cover to open the open upper surface of the housing. Thus, the image forming unit and the developing unit can be removed from and placed in the housing without reretiring and additional parts.

DETAILED DESCRIPTION OF THE PREFERRED EMBODIMENTS

Figure 1:
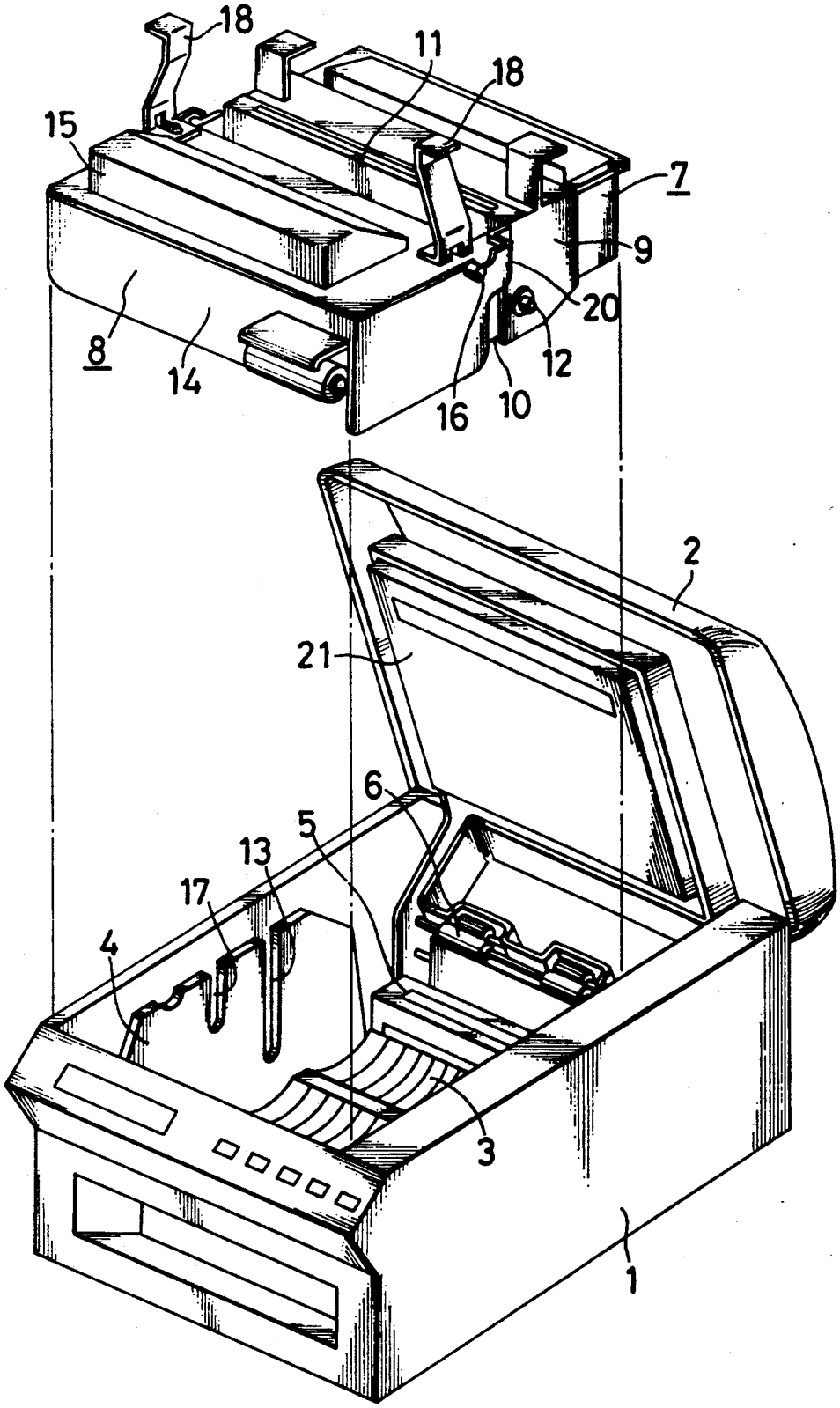
FIG. 1 is an exploded perspective view of an electrophotographic apparatus in a first embodiment according to the present invention.
Figure 2:
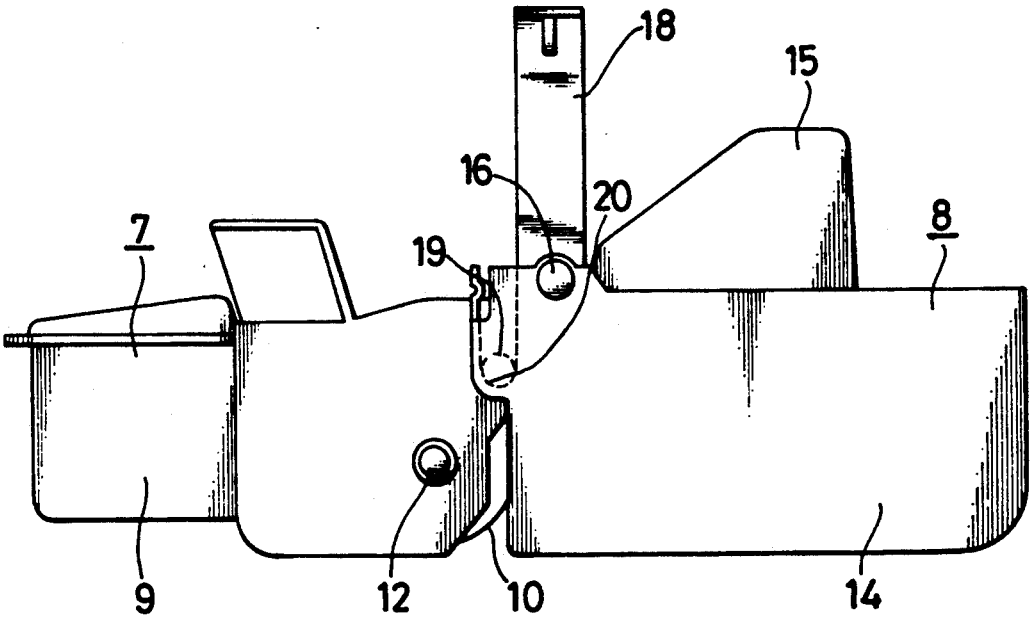
FIG. 2 is a side view of a combination of an image forming unit and a developing unit.
Figure 3:
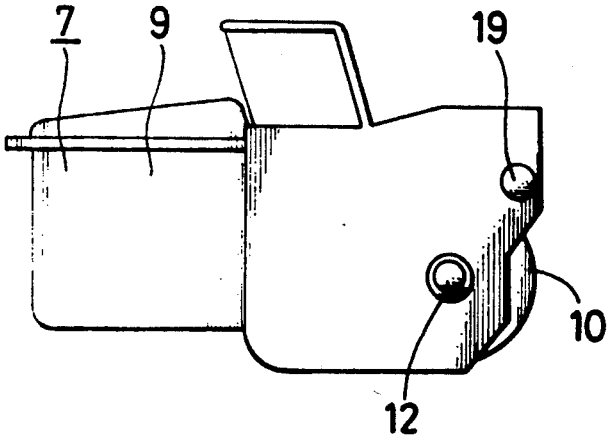
FIG. 3 is a side view of the image forming unit.
Figure 4:
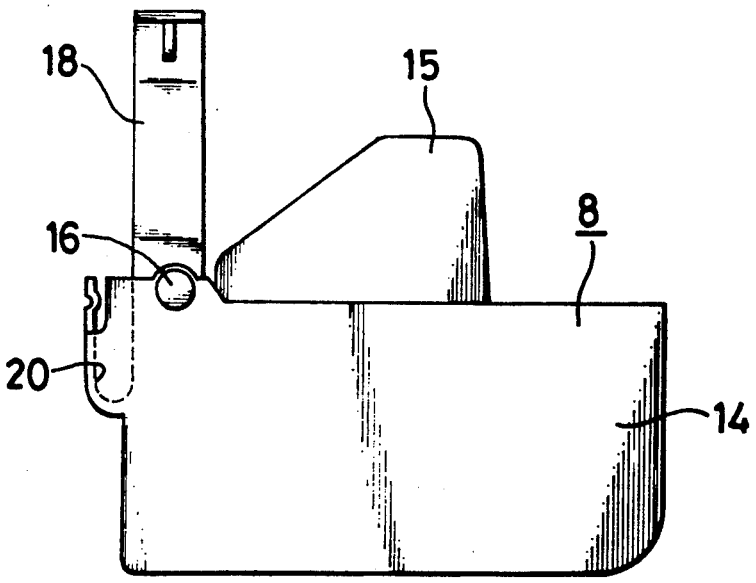
FIG. 4 is a side view of the developing unit.

An electrophotographic apparatus in a first embodiment according to the present invention will be described with reference to FIGS. 1 to 5. Referring to FIGS. 1 to 5, a top cover 2 is joined pivotally to a housing 1 so as to close the open upper surface of the housing 1. Side plates 4 are disposed in the housing 1 on the opposite sides, respectively, of a sheet transportation path 3 formed in the housing 1. A transfer unit, not shown, for transferring a toner image formed on the outer circumference of a photoconductive drum 10, which will be described later, to a sheet, a fixing unit 5 for fixing the toner image transferred to the sheet to the same, and a delivery roller 6 are arranged along the sheet transportation path 3. An image forming unit 7 and a developing unit 8 are disposed above the sheet transportation path 3 in the housing 1. The image forming unit 7 comprises a waste toner container 9, the photoconductive drum 10 supported for rotation on the waste toner container 9, and a charger 11 for applying a voltage to the photoconductive drum 10, attached to the waste toner container 9. The waste toner container 9 is provided with bearings 12 for supporting the photoconductive drum 10 for rotation at the opposite ends thereof. The side plates 4 are provided with U-shaped slots 13 for receiving and locating the bearings 12 so that the bearings 12 can be removed upward therefrom. The developing unit 8 comprises a developing device, a blade, a stirrer, a toner container 14 containing the developing device, the blade and the stirrer, and a toner cartridge 15 having an opening in its lower surface and inserted in an opening formed in the upper wall of the toner container 14. Pins 16 project outward from the opposite side walls of the toner container 14. The side plates 4 is provided also with U-shaped slots 17 for receiving and locating the pins 16. Handles 18 are fixed to the opposite side walls of the toner container 14 so as to project upward. The handles 18 are formed of a soft material, such as polypropylene, and capable of being bent at their base ends. The handles 18 are attached to the toner container 14 at positions in a vertical plane including the center of gravity of the combination of the image forming unit 7 and the developing unit 8 in a state where half the toner contained in the toner cartridge 15 has been consumed.

As shown in FIG. 2 to 5, pins 19 project outward from the opposite side walls of the image forming unit 7, and supporting members 20 provided with U-shaped slots for receiving the pins 19 are provided on the inner surfaces of the opposite side walls of the developing unit 8. As shown in FIG. 1, an exposure unit 21 for applying light signals representing image signals to the photoconductive drum 10 is attached to the inner surface of the top cover 2. A delivery tray, not shown, is formed on the top surface of the top cover 2.

Figure 6:
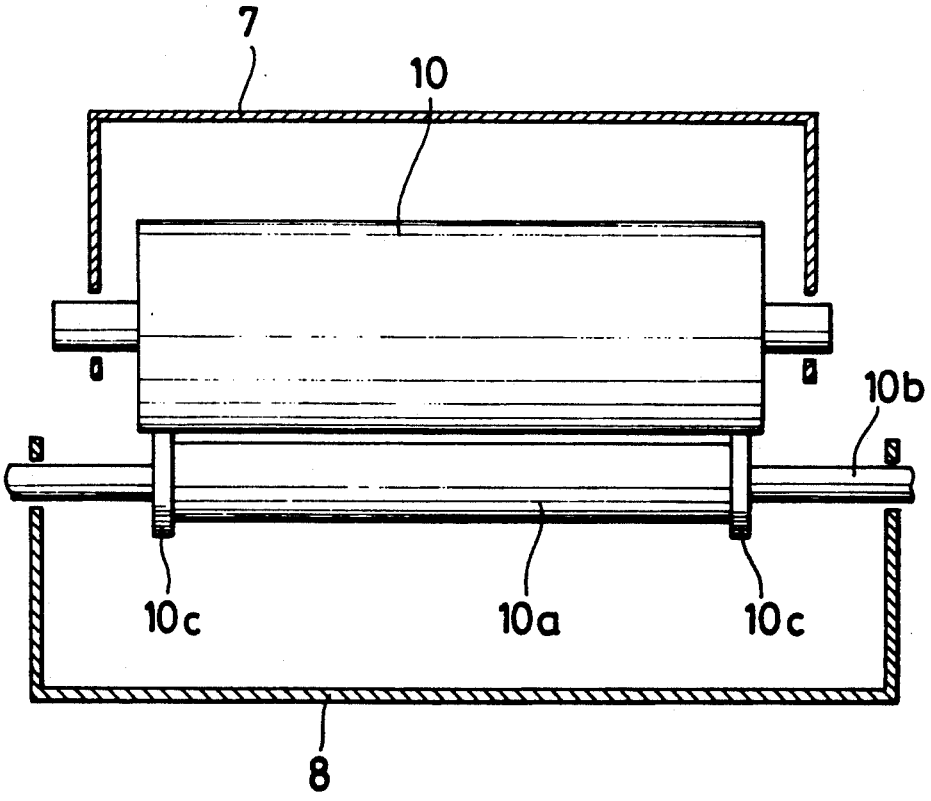
FIG. 6 is a perspective view of an electrophotographic apparatus in a second embodiment according to the present invention.
Figure 7:
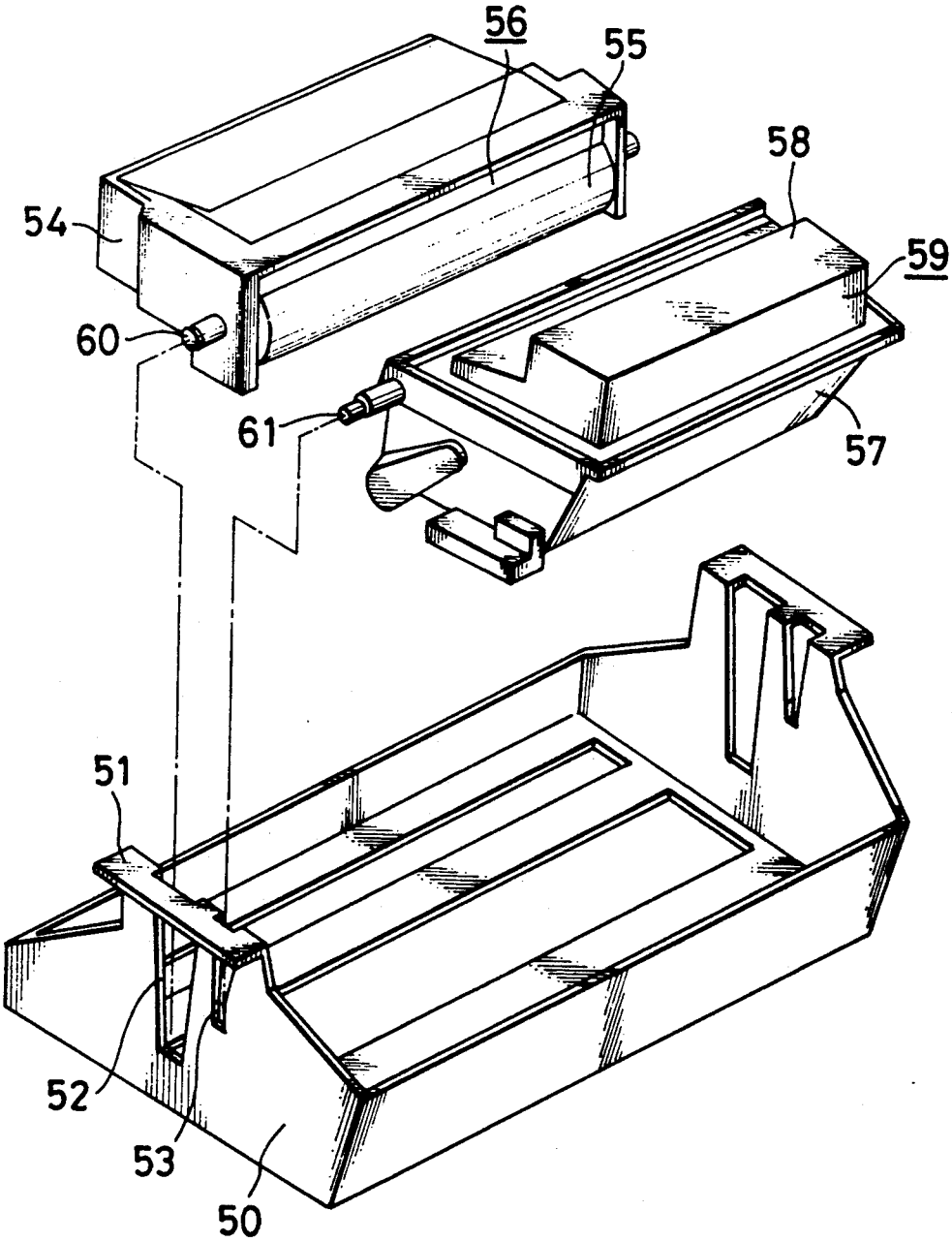
FIG. 7 (PRIOR ART)
FIG. 7 is an exploded perspective view of a conventional electrophotographic apparatus.

As shown in FIG. 6, the position of the developing sleeve 10*a* of the developing unit 8 relative to the photoconductive drum 10 is determined by means of gap adjusting disks 10*c* attached to the shaft 10*b* of the developing sleeve 10*a*. The developing sleeve 10*a* is disposed relative to the photoconductive drum 10 so that the gap adjusting disks 10*c* are in rolling contact with the circumference of the photoconductive drum 10.

The image forming unit 7 is held stably in place with the bearings 12 received in the slots 13 and with the pins 19 received in the slots of the supporting members 20 of the developing unit 8. The developing unit 8 is held stably in place with the pins 16 received in the slots 17 and with the opposite ends of the developing roller thereof in contact with part of the image forming unit 7. In removing the developing unit 8 together with the image forming unit 7 from the housing 1, the developing unit 8 is held at the handles 18 and the same is lifted up together with the image forming unit 7 after turning the top cover 2 to open the open upper surface of the housing 1. Thus, any additional parts are not needed to remove the developing unit 8 and the image forming unit 7 together from and to place the same in the housing 1. Thus, the electrophotographic apparatus comprises a reduced number of parts, the housing 1 can be formed in a reduced size, and the electrophotographic apparatus can be fabricated at a reduced cost. Since the handles 18 of the developing unit 8 can be bent at the respective base ends, the developing unit 8 can be packed for transportation in a small package.

Since the image forming unit 7 is combined with the developing unit simply by inserting the pins 19 thereof in the U-shaped slots of the supporting members 20 of the developing unit 8, the image forming unit 7 can readily be separated from the developing unit 8 simply by pulling up the image forming unit 7 relative to the developing unit 8. The image forming unit 7 and the developing unit 8 can readily be assembled simply by lowering the image forming unit relative to the developing unit 8 so that that the pins 19 are received in the supporting members 20.

Figure 5:
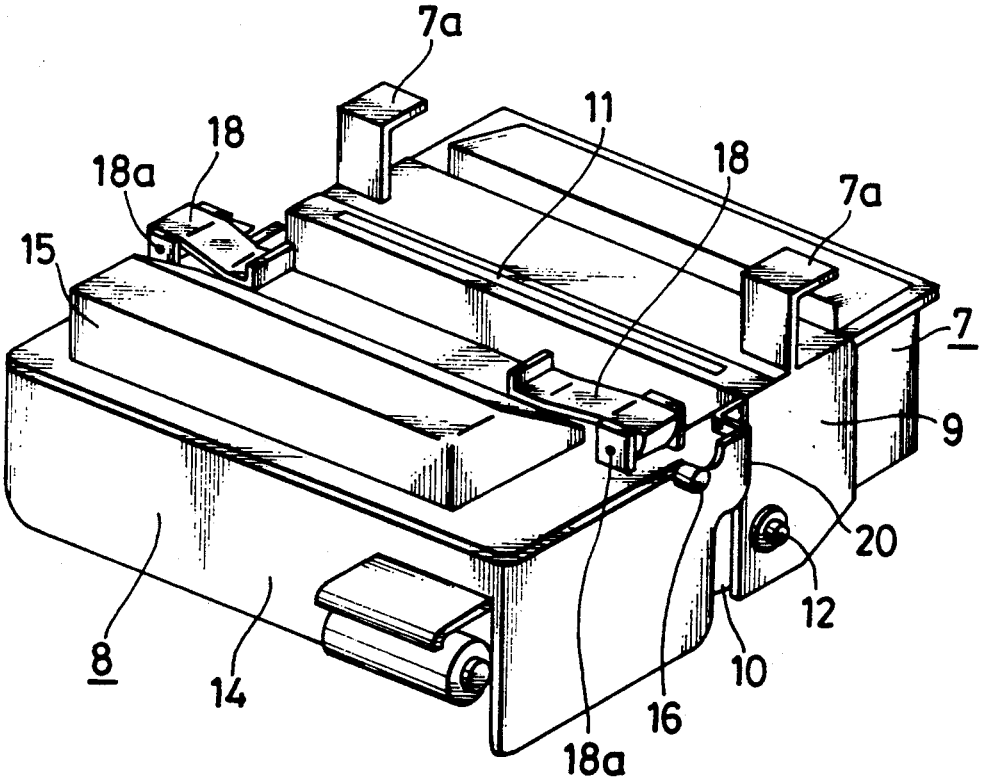
FIG. 5 is a schematic plan view showing the positional relation between the image forming unit and the developing unit.

An electrophotographic apparatus in a second embodiment according to the present invention will be described with reference to FIG. 5, in which parts like or corresponding to those of the electrophotographic apparatus in the first embodiment will be denoted by the same reference characters and the description thereof will be omitted. The developing unit 8 of the electrophotographic apparatus in the second embodiment is provided with hinged handles 18, and the image forming unit 7 of the same is provided with a L-shaped handles 7*a*.

The image forming unit 7 is replaced with a new one at the termination of its photoconductive drum 10, while the developing unit 8 maintains its functions for a considerable long time only if the same is replenished with the toner. The handles 7*a* of the image forming unit 7 enables removing only the image forming unit 7 from the housing 1 to simplify replacing the photoconductive drum 10 with a new one. The handles 18 of the developing unit 8 enables removing the developing unit 8 together with the image forming unit 7 from the housing 1 to replace the photoconductive drum 10 in replenishing the developing unit 8 with the toner.

Thus, the electrophotographic apparatus in accordance with the present invention comprises a housing containing a sheet transportation path, a transfer unit and a fixing unit, and having an open upper surface; a top cover holding an exposure unit and pivotally supported on the housing so as to cover the open upper surface of the same; an image forming unit comprising at least a photoconductive drum and a charger; a developing unit provided with a toner container; holding members disposed in the housing on the opposite sides, respectively, of the sheet transportation path to hold the image forming unit and the developing unit so as to be removed upward therefrom supporting members provided in the developing unit to support the image forming unit; and handles attached to the developing unit so as to extend upward from the developing unit. Since the image forming unit is supported on the supporting members of the developing unit, the image forming unit can be removed together with the developing unit from the housing by holding the developing unit at the handles and lifting up the same after turning the top cover to open the open upper surface of the remove the image forming unit and the developing unit from and placing the same in the housing, so that the electrophotographic apparatus has a reduced number of parts, the housing can be formed in a reduced size, and the electrophotographic apparatus can be fabricated at a reduced cost.

What is claimed is:

1. An electrophotographic apparatus comprising:

a housing comprising a sheet transportation path, a transfer unit and a fixing unit, said housing further comprising an open upper surface;

an image forming unit comprising a photoconductive drum;

a developing unit comprising a toner container;

holding members disposed on opposite sides of the sheet transportation path arranged in the housing to hold the image forming unit and the developing unit so that the image forming unit and the developing unit can be removed upward therefrom;

supporting means in the developing unit for supporting the image forming unit in a supported engaging state and permitting the removal in an upward direction of the image forming unit from the developing unit when the developing unit with the image forming unit supported thereon are both positioned on the holding members of the housing; and handle means for removing the developing unit with the image forming unit supported thereon from the housing while maintaining said supported engaging state between said developing unit and said image forming unit, said handle means being provided on the developing unit and extending from the developing unit.

2. An electrophotographic apparatus according to claim 1, wherein said handle means are formed of a soft material.

3. An electrophotographic apparatus according to claim 1, wherein said handle means are hinged to said developing unit.

4. An electrophotographic apparatus according to claim 1, wherein bearings for rotatably supporting the photoconductive drum are received in the holding members provided on said housing.

5. An electrophotographic apparatus according to claim 1, wherein said supporting members provided in the developing unit have U-shaped slots opening upward, respectively, the image forming unit is provided with pins extending so as to be received in the U-shaped slot of said supporting members, and the image forming unit is supported detachably on the developing unit with the pins received in the U-shaped slots of said supporting members.

6. An electrophotographic apparatus according to claim 1, wherein the image forming unit is provided with handles.

7. An electrophotographic apparatus comprising:

a housing comprising a sheet transportation path, a transfer unit and a fixing unit, said housing further comprising an open upper surface;

an image forming unit comprising a photoconductive drum;

a developing unit comprising a toner container;

holding members fixedly disposed in said housing on opposite sides of the sheet transportation path arranged in the housing to hold the image forming unit and the developing unit so that the image forming unit and the developing unit can be removed upward therefrom;

supporting means in the developing unit for supporting the image forming unit in a supported engaging state, said supporting means defining an upwardly extending U-shaped slot for permitting the removal in an upward vertical direction of the image forming unit from the developing unit when the developing unit with the image forming unit supported thereon are both positioned on the holding members of the housing; and handle means for removing the developing unit with the image forming unit supported thereon from the housing while maintaining said supported engaging state between said developing unit and said image forming unit, said handle means being provided on the developing unit and extending from the developing unit.

* * * * *

UNITED STATES PATENT AND TRADEMARK OFFICE

CERTIFICATE OF CORRECTION

PATENT NO. : 5,204,713

DATED : April 20, 1993

INVENTOR(S) : Naoki Yamamura

It is certified that error appears in the above-identified patent and that said Letters Patent is hereby corrected as shown below:

On the title page, Item [54],

The Title is incorrect, should read: --ELECTROPHOTOGRAPHIC APPARATUS HAVING DETACHABLE IMAGE FORMING AND DEVELOPING UNITS--

Signed and Sealed this

Eighteenth Day of January, 1994

*Attest:*

Bruce Lehman

BRUCE LEHMAN

*Attesting Officer*

*Commissioner of Patents and Trademarks*